US007299837B2

(12) United States Patent
Gilbert et al.

(10) Patent No.: US 7,299,837 B2
(45) Date of Patent: Nov. 27, 2007

(54) PLANING HEADS ASSEMBLY FOR AN AUTOMATED PLANING MACHINE

(75) Inventors: Sylvain Gilbert, St-Prime (CA); Daniel Paré, St-Prime (CA)

(73) Assignee: Les Produits Gilbert, Inc., Roberval (Quebec) (CA)

( * ) Notice: Subject to any disclaimer, the term of this patent is extended or adjusted under 35 U.S.C. 154(b) by 0 days.

(21) Appl. No.: 11/263,256

(22) Filed: Oct. 31, 2005

(65) Prior Publication Data

US 2007/0095428 A1 May 3, 2007

(51) Int. Cl.
*B27C 1/00* (2006.01)

(52) U.S. Cl. ..... 144/116; 144/114.1; 144/117.1

(58) Field of Classification Search ..... 144/116, 144/114.1, 117.1, 129, 130, 117.4
See application file for complete search history.

(56) References Cited

U.S. PATENT DOCUMENTS 1,458,428 A * 6/1923 Mallberg ..... 82/92
2,102,186 A * 12/1937 Nicholson et al. ..... 144/116
3,965,948 A * 6/1976 Lundin ..... 144/3.1
4,323,099 A * 4/1982 Bost ..... 144/4.2
4,457,350 A 7/1984 Finnila
5,368,077 A * 11/1994 Croghan et al. ..... 144/117.1
5,396,938 A 3/1995 Cannaday
5,477,899 A * 12/1995 Schmitt ..... 144/116
5,649,580 A 7/1997 Mierau et al.
6,247,511 B1 6/2001 Maeda et al.
6,323,452 B1 11/2001 Bonnet
6,666,246 B2 12/2003 Gilbert

* cited by examiner

*Primary Examiner*—Bena Miller
(74) *Attorney, Agent, or Firm*—Myers Bigel Sibley & Sajovec, PA

(57) ABSTRACT

A planing heads positioning device to be used with an automatic planing machine for planing sides of a piece of lumber moving along a travelling course is provided. The device includes a main frame and a planing assembly including first and second planing head arranged on opposite sides of the travelling course. The planning assembly further includes first and second supports respectively supporting the first and second planing heads. The first support is slidably mounted to the main frame, and the second support is operatively connected to the first support. The device also includes a primary positioning mechanism connected to the first support to position the planing assembly relative to the main frame; and a secondary positioning mechanism operatively connected to the supports to modify the planing width.

18 Claims, 21 Drawing Sheets

PLANING HEADS ASSEMBLY FOR AN AUTOMATED PLANING MACHINE

FIELD OF THE INVENTION

This invention generally relates to lumber processing and sawmill equipment, and more specifically to improvements in a planing heads assembly for an automated planing machine.

BACKGROUND OF THE INVENTION

Planing machines are used in the lumber industry to plane lumber, giving different pieces of lumber specific profiles. Automatic planing machines usually include a feed table, upper and lower planing heads (also called cylinders), a linebar, and right and left side planing heads. The feed table is used for the preliminarily vertical positioning of the piece of lumber with respect to the upper and lower planing heads. The linebar is usually fixed and is used to laterally guide the piece of lumber along a travelling course in the planing machine. The side planing heads, usually right and left, are used to plane the side surfaces of the piece of lumber. They define a planing width therebetween.

The U.S. Pat. No. 6,666,246 (GILBERT) teaches an automatic planing machine which also includes an automated positioning system for improving the performance of the machine. This positioning system is provided with positioning means for adjusting the position of at least one of the planing heads and further includes position encoders for producing the position signals indicating the height of the feed table and the planing level of at least one of the planing heads. Thus, the piece of lumber and the planing levels are closely monitored and can be quickly adjusted to achieve high production rates and improved planing quality.

FIGS. 20 and 21 (PRIOR ART) represent prior art in side planing heads positioning devices for automated planing machines as taught by the above-mentioned U.S. patent. As can be appreciated in these Figures, the planing heads positioning device 30 includes a main frame 32, to which an intermediate module 34 is mounted with linear slides 36. The first planing head 38 and second planing head 40, both being side planing heads, are respectively mounted to sub-frames 41A, 41B. The intermediate module 34 can be slid and positioned with respect to the main frame and the sub-frames 41A, 41B can be positioned with respect to each other to make the planing width larger or smaller. This setup requires drive means for both sub-frames and for the intermediate module, and therefore suffers from drawbacks associated with the extra weight and complications arising therefrom.

According to U.S. Pat. No. 6,666,246, the side planing heads can be moved individually by positioning means, or simultaneously on a mobile frame, which is slidably connected to the main frame. Planing heads positioning devices are units that are usually heavy, including multiple frames and/or positioning components. In planing operations, the masses and speeds of the moving components are important factors that have a direct effect on the efficiency and durability of the system. The inertia of large or heavy components of the machine imposes certain difficulties. Heavy components are more difficult to control and handle and may increase the wear on the system. Precisely and rapidly adjusting such massive components, for example with heavy positioning means and position encoders, can pose problems.

Furthermore, for piece by piece positioning, it is important to be able to make small adjustments to the position of the planing heads in order to account for variations in the incoming raw piece of lumber. It is advantageous for a planing heads positioning device to be able to position the right and left planing heads simultaneously, thus shifting the travelling course of the piece of lumber without changing the planing width. It is also advantageous for the device to be able to position the planing heads relative to each other, thus changing the planing width defined therebetween. In the prior art, devices for positioning planing heads have comprised various assemblies. In one assembly, the planing heads (right and left) are each mounted to separate mobile frames, and the frames are slid back and forth on the main frame by pairs of screw members. In another design, two mobile frames supporting the planing heads are mounted on an intermediary module or frame, which, in turn, is mounted on the main frame and can be slid back and forth thereon. This second design enables the planing heads to be positioned simultaneously or individually, but includes three frames as well as three motorized drive means to move them. The prior art therefore teaches heavy and complicated assemblies including numerous supports and numerous drive means for positioning planing heads.

Another disadvantage of the prior art is that conventional planing machines use transmission systems with a single screw offset with respect to the axis of the side planing heads to move them. This offset makes displacement more difficult, inaccurate and increases the wear of the components. The required torque to effectuate the movement is also increased, jams are more frequent and durability of the components suffers.

There is thus a need for an improvement of planing heads positioning devices in automated planing machines, which up to now have incorporated massive and awkward components that cause various inefficiencies, component wear, complexities and other disadvantages.

SUMMARY OF THE INVENTION

The present invention overcomes several of the above mentioned drawbacks and has advantages over the prior art, by providing an improved planing heads positioning device.

The present invention thus provides a planing heads positioning device to be used with an automatic planing machine having a main frame, for planing sides of a piece of lumber moving along a travelling course. The device includes a planing assembly. The planing assembly includes a first planing head and a second planing head respectively arranged on opposite sides of the travelling course of the piece of lumber and defining a planing width between them. The planing assembly also includes a first support and a second support respectively and fixedly supporting the first and second planing heads. The first support is slidably mounted on the main frame and the second support is operatively connected to the first support. The device also includes a primary positioning mechanism operatively connected to the first support to position the planing assembly relative to the main frame. The device further includes a secondary positioning mechanism operatively connected to the first and second supports to position the second support relative to the first support, thereby changing the planing width, to plane the sides of the piece of lumber.

In one embodiment of the invention, the second support is slidably mounted on the first support. The first support is advantageously a large plate-shaped support, and acts as an intermediary frame. Transmission members are provided for positioning the first and second supports. In this embodiment, there are two supports and two positioning mechanisms.

In a variant of the above mentioned embodiment, the second support is slidably mounted to the main frame, and is operatively connected to the first frame via at least one secondary transmission member. In this case, there are two supports that are preferably small and light, and of similar dimensions, thus making up one structure; and two positioning mechanisms.

BRIEF DESCRIPTION OF THE DRAWINGS

These and other objects and advantages of the invention will become apparent upon reading the detailed description and upon referring to the drawings in which.

Figure 1:
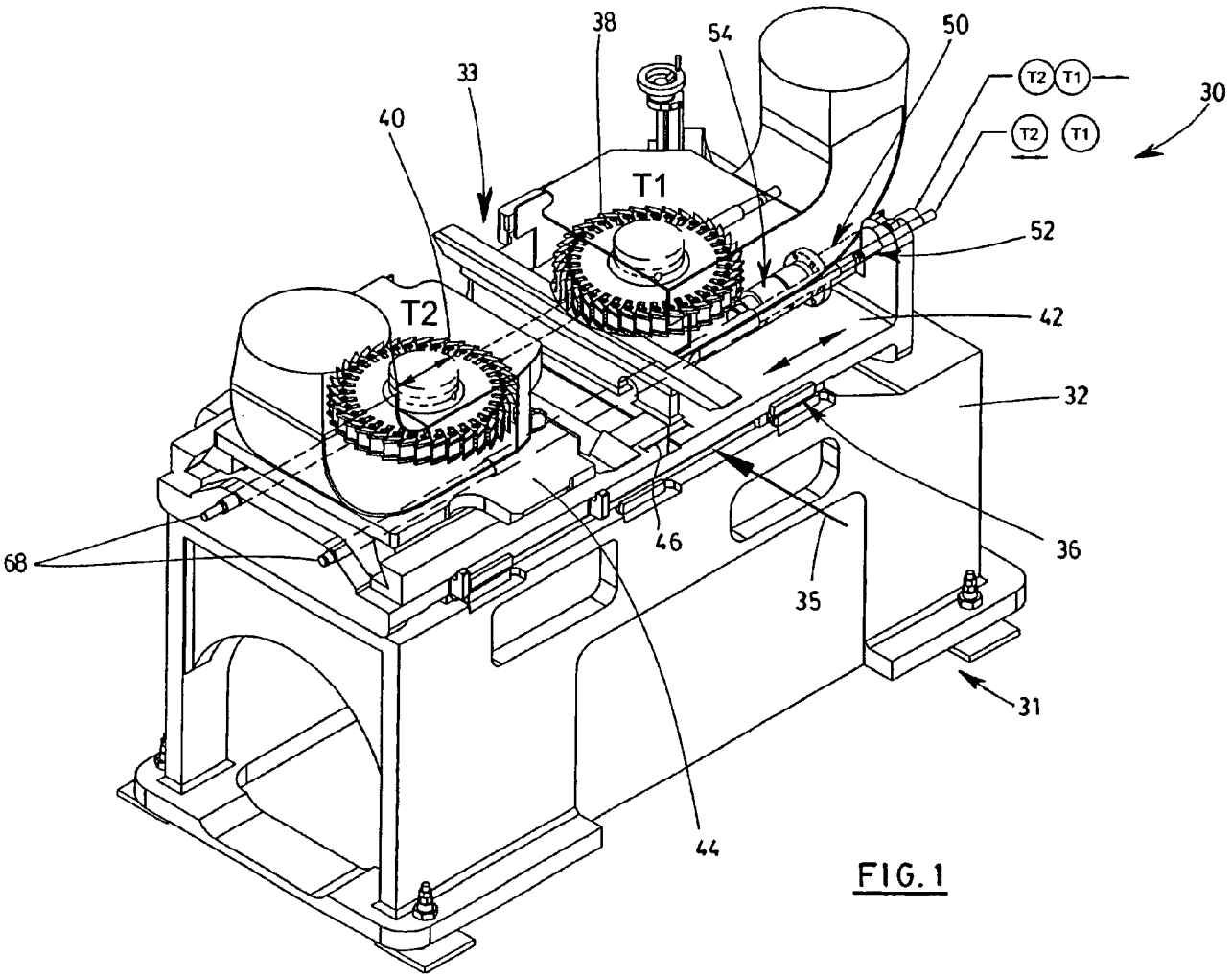
FIG. 1 is a perspective view of a preferred embodiment of the planing heads device, according to the present invention.

While the invention will be described in conjunction with example embodiments, it will be understood that it is not intended to limit the scope of the invention to such embodiments. On the contrary, it is intended to cover all alternatives, modifications and equivalents as may be included as defined by the appended claims.

DESCRIPTION OF A PREFERRED EMBODIMENT

In the following description, similar features in the drawings have been given similar reference numerals, and in order not to weigh down the figures, some elements are not referred to in some figures if they were already identified in a precedent figure.

The planing heads positioning device according to the present invention is preferably incorporated into an automated planer machine, but could also be used with manual lumber planing machines or with other machines in the timber, furniture, or other processing industries.

With reference to FIGS. 1 to 11, there is shown a planing heads positioning device 30 according to one embodiment of the present invention.

Referring more particularly to FIG. 1, the planing head positioning device 30 may preferably be used with an automatic planing machine 31. The planing positioning device 30 planes the sides of a piece of lumber (not shown) moving along a traveling course 35. The invention primarily relates to planing the lateral sides of a piece of lumber. However, the principles of the planing heads positioning device 30 according to the invention could be easily adapted for planing heads that plane other parts of a piece of lumber. The positioning device 30 includes a main frame 32 which may be fixed by bolts, screws, cementing or other fastening means, to the ground.

A planing assembly 33 is arranged on the main frame 32. The planing assembly 33 includes a first planing head 38 and a second planing head 40 and may also include additional planing heads (not shown). It will be understood that the designations of "first" and "second" planning heads are used herein for ease of reference only and do not denote any particular hierarchy between these components. Also, multiple planing assemblies 33 may be arranged in series to plane the piece of lumber. The first 38 and second 40 planing heads are arranged on opposite sides of the traveling course of the piece of lumber. The planing assembly 33 further includes a first support 42 and a second support 44 fixedly supporting the first 38 and second 40 planing heads, respectively. The supports 42, 44 are displaced in order to adjust the planing heads 38, 40.

The planing heads 38, 40 define a planing width 46 between them. Preferably, the planing width 46 is adjusted according to the desired width to be bestowed on the piece of lumber. Also, if pre-analysis of an incoming raw piece of lumber shows that the raw lumber is not suitable to be planed at the current planing width (i.e. the raw lumber is too curved, or has an imperfection in it), then the planing width 46 may be individually adjusted according to that specific piece of lumber. With such quick adaptations, pieces of lumber are rarely discarded due to miscalculated processing and do not have to be reprocessed.

The first and second supports 42, 44 are preferably metallic, plate-shape and are constructed to be as lightweight as possible. The planing heads 38, 40 are preferably fixed on their respective supports 42, 44 to enable rotation of the planing head blades to plane the lumber, but the planing heads 38, 40 may also be movably (rotatably, pivotally, etc.) mounted in order to plane the piece of lumber at different angles.

Figure 11:
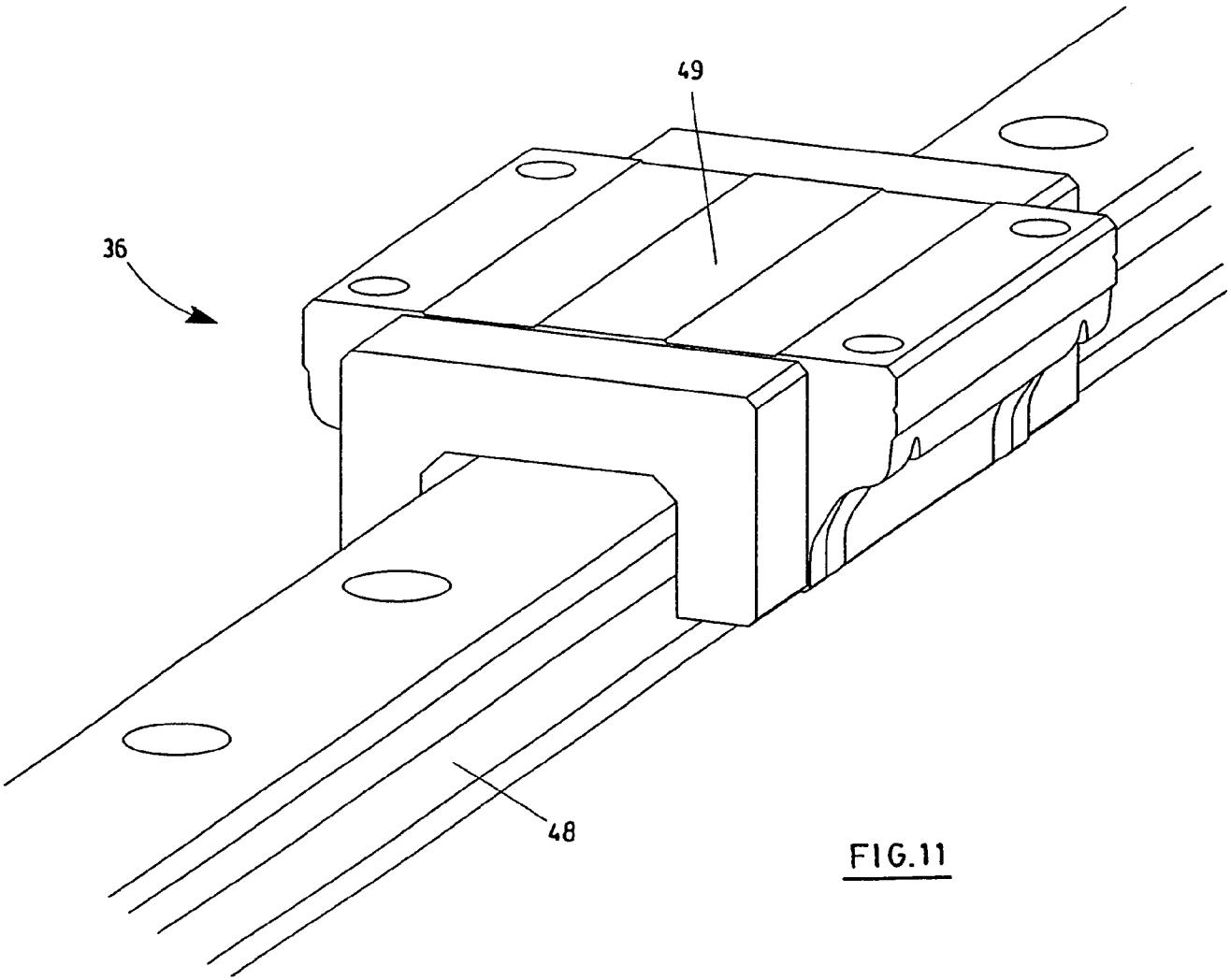
FIG. 11 is a perspective view of the region XI of FIG. 10 and FIG. 17.

Referring to FIGS. 1 and 11, The first support 42 is slidably mounted on the main frame 32, preferably with linear slides 36. As shown in FIG. 1, the linear slides 36 are preferably mounted beneath the front and back lengths of the first support 42. FIG. 11 shows a close up view of the linear slide 36 according to one embodiment, in which it includes a rail 48 and a slide car 49 slidably mounted thereon. Preferably, the rail 48 is fixedly mounted on the main frame 32 while the slide car 49 is fixedly mounted to the first support 42. Other slide means could also be used to slide the first support 42 relative to the main frame 32, such as rollers, bearings, rails or other systems.

Figure 8:
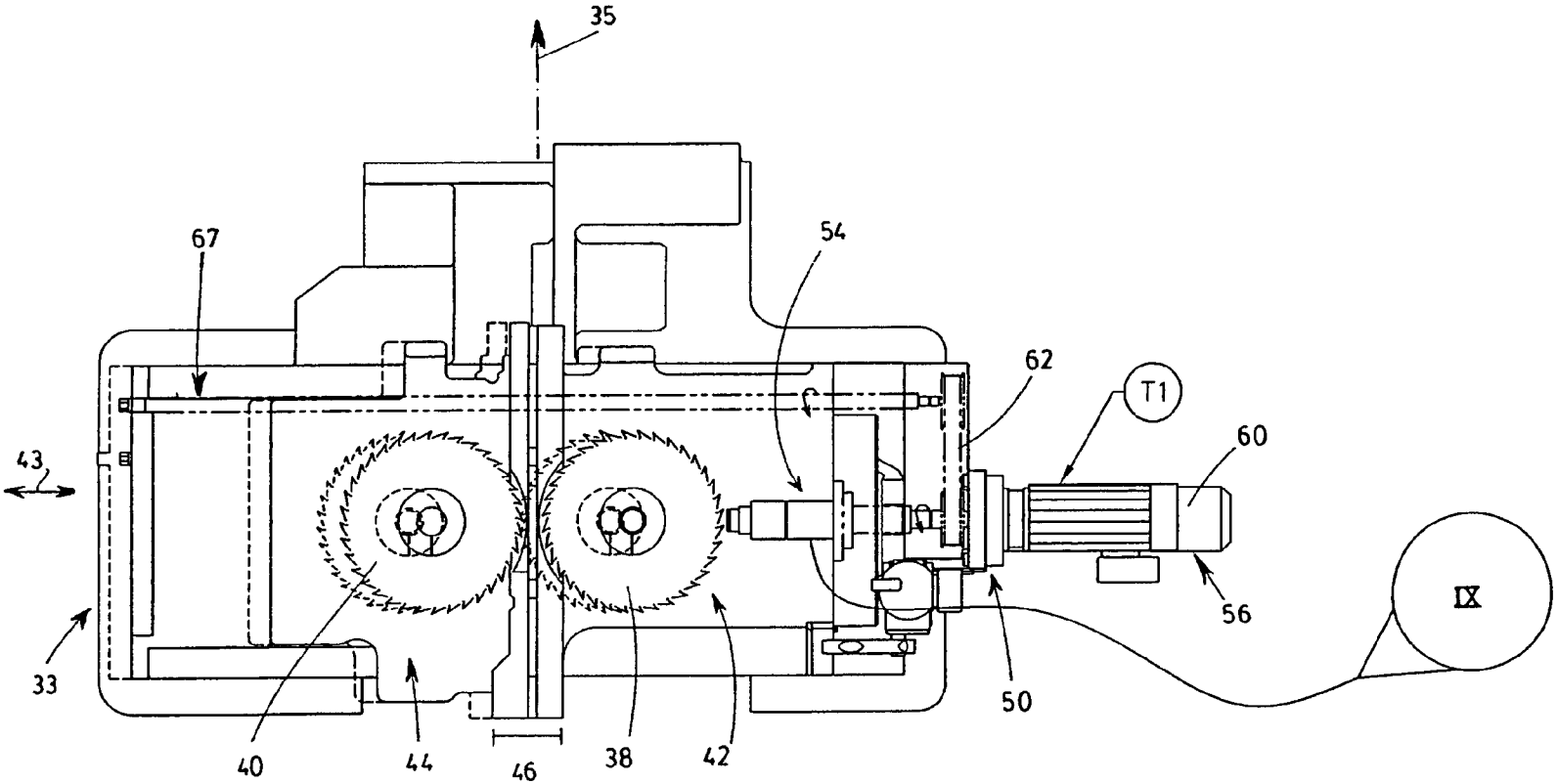
FIG. 8 is a top view of the device, according to the first embodiment of the invention, showing positioning of the first and second supports.
Figure 10:
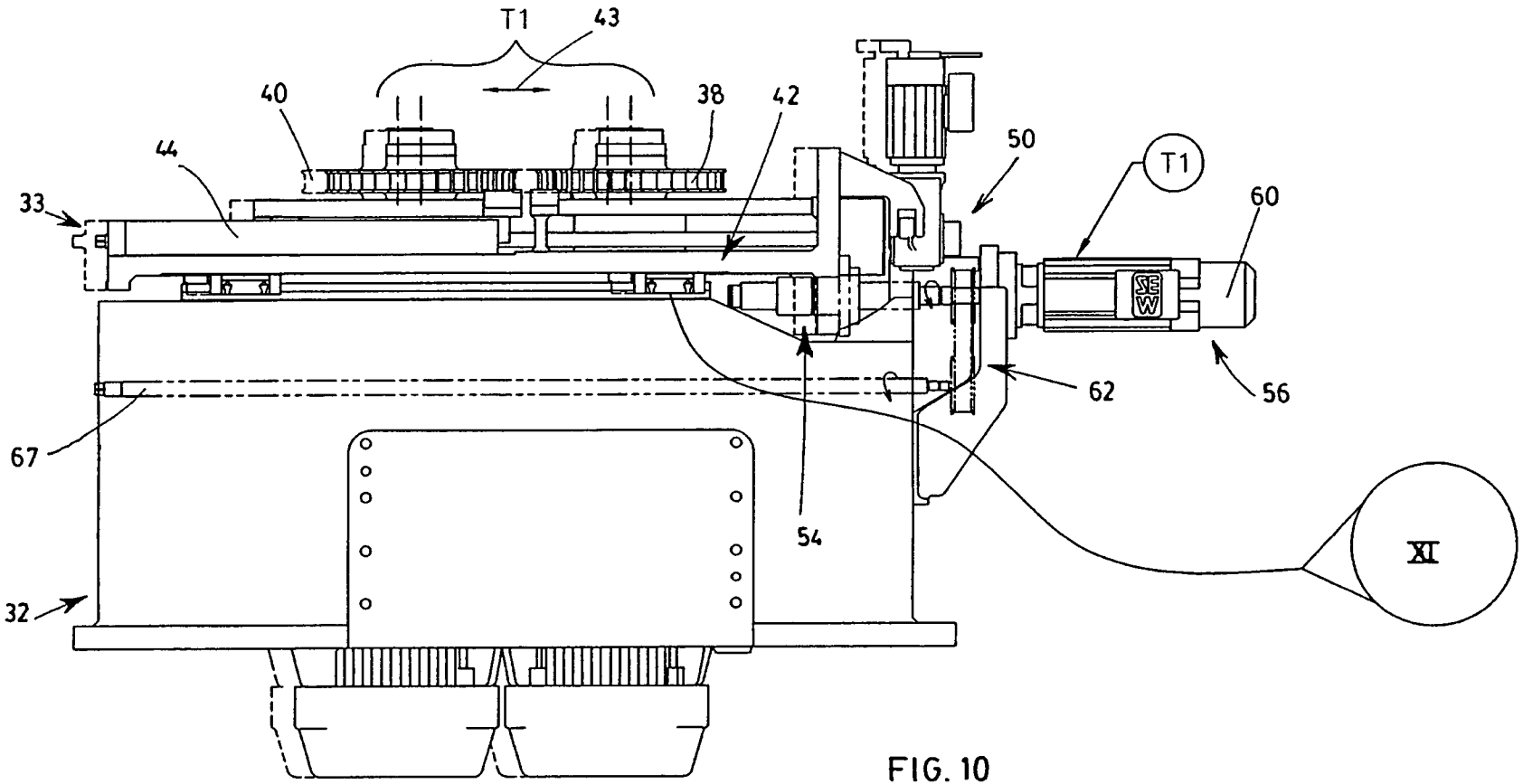
FIG. 10 is a side view of the device of FIG. 8.

Referring to FIGS. 8 and 10, the first support 42 slides along a sliding axis 43 perpendicular to the travelling course 35 of the piece of lumber, in order to laterally change said travelling course or modify the planing of the piece of lumber. The displacement of the first support 42 moves the entire planning assembly, and therefore moving the first 38 and second 40 planing heads simultaneously, thereby maintaining the planing width 46 at a constant value. In other words, both planing heads 38, 40 are displaced with respect to the main frame 32 but are static with respect to each other.

Figure 9:
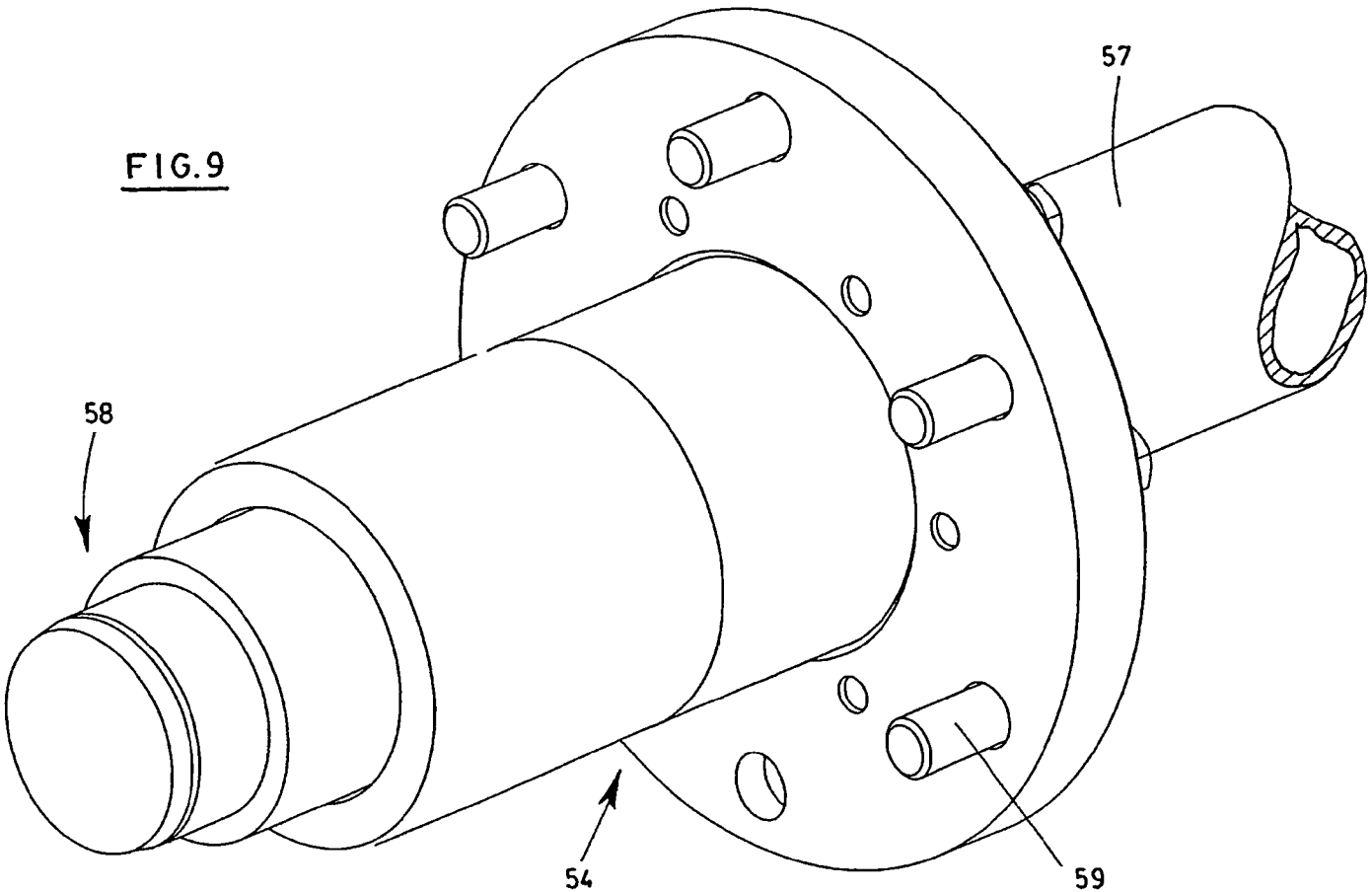
FIG. 9 is a perspective view of the region IX of FIG. 8 and FIG. 12.

Still referring to FIGS. 8 and 10 and further referring to FIG. 9, in order to simultaneously position the first and second planning heads 38 and 40, a primary positioning mechanism 50 is operatively connected to the first support 42 to displace the entire planing assembly 33 relative to the main frame 32. According to a preferred embodiment of the present invention, the primary positioning mechanism 50 includes a primary transmission member 54 that engages the first support 42 and a primary drive 56 for driving the primary transmission member 54. The primary transmission member 54 is adapted to cause the planing assembly 33 to slide substantially perpendicularly relative to the travelling course of the piece of lumber. Of course, a person skilled in the art may arrange the planing assembly 33 on the main frame 32, as well as other components making up the device 30, so that the piece of lumber travels at different angles relative to the displacement of the assembly 33. As shown in FIG. 9, the primary transmission member 54 advantageously comprises a screw shaft 57 and a co-centric shaft assembly 58, which preferably comprises a wingnut element bolted to the first support, for pushing the first support 42. The shaft assembly 58 is fixed to the first support 42 and is operatively connected to the screw shaft 57, which is in turn rotated by the primary drive 56. The rotation of the screw shaft 57 causes the axial translation of the shaft assembly 58, which displaces the first support 42. Fasteners 59 such as bolts may also be provided on the shaft assembly 58, as shown in FIG. 9.

Preferably, the primary transmission member 54 is operatively connected to an a stabilizing member 67 embodied by an additional transmission member, as shown in FIGS. 8 and 10. The two members 54, 67 are interconnected with a belt assembly 62 so that they rotate together. This stabilizing member 67 provides stability and promotes consistent displacement of the positioning assembly 33, particularly diminishing oscillations during processing and promoting straight lateral movement, but may also enable the transmission of another element of the automated planing machine.

The primary drive 56 of the primary transmission member 54 preferably includes a motor, which is advantageously a servo-motor 60, which is operatively mounted to the screw shaft 57, and preferably mounted to the main frame. On the other hand, the primary transmission member 54 may include another means of translating the planing assembly 33 relative to the main frame 32, including an arrangement of screws and translators (such as wingnut-like components).

Figure 2:
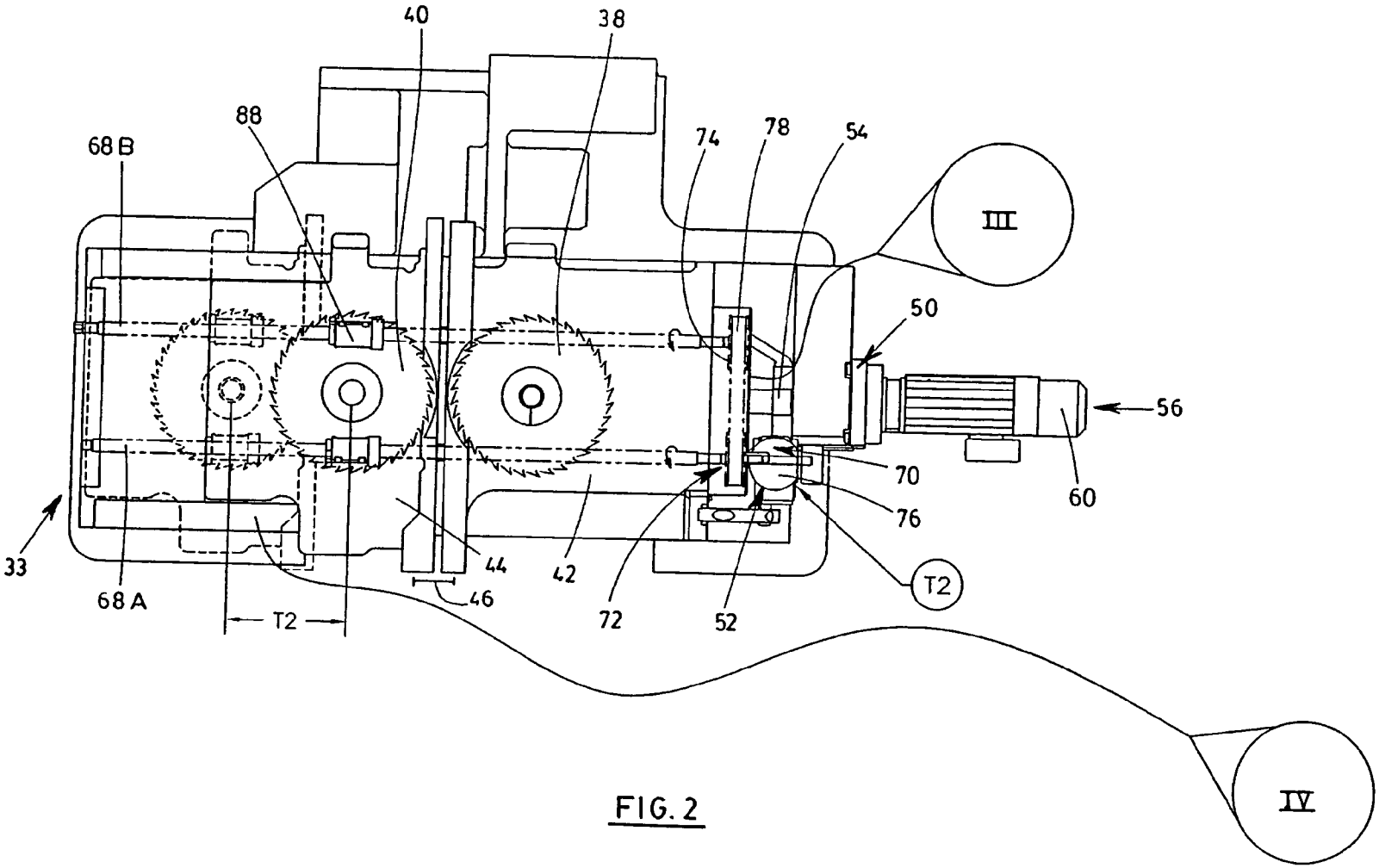
FIG. 2 is a top view of the device, according to the preferred embodiment of the invention, showing positioning of the second support.
Figure 6:
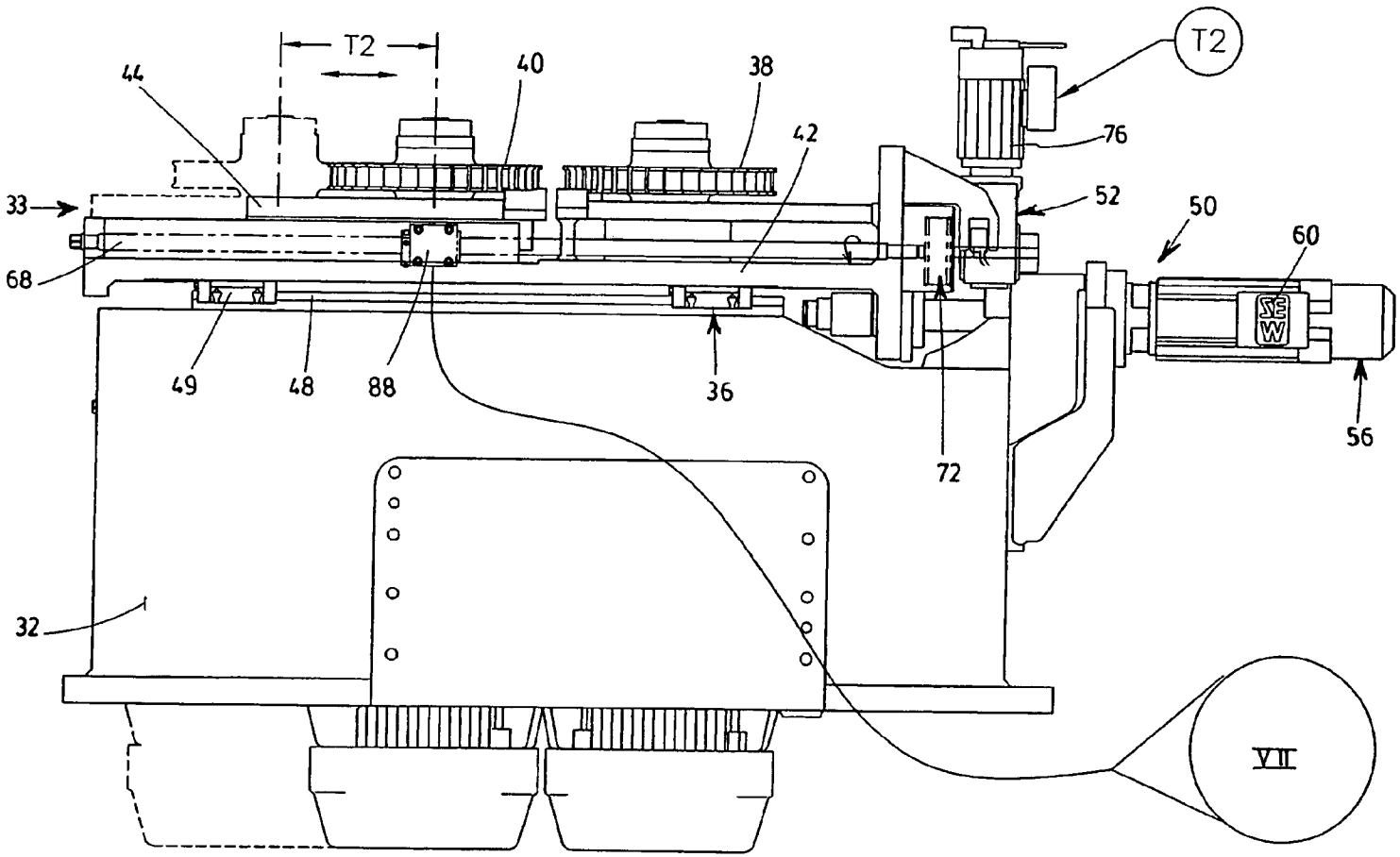
FIG. 6 is a side view of the device of FIG. 2.

Referring to FIGS. 2 and 6, the primary transmission member 54 preferably engages the first support 42 substantially along a central axis of the first planing head 38, as can be seen in FIG. 2. Preferably, the primary member 54 is mounted underneath the first planing head 38, as can be seen in FIG. 6. The primary transmission member 54 is so arranged to advantageously enable the first support 42 to slide smoothly on the main frame 32, and to avoid jams and problems with positioning the first support 42. One advantage of arranging the primary transmission member 54 in the central axis of the first head 38 is that the main weight sits on this central axis, and thus the primary transmission member 54 can better move the first support 42 by engaging it at its heaviest point. Alternatively, a skilled workman could mount the primary transmission member 54 to the first support 42 in any way in order to ensure smooth sliding of the first support 42 on the main frame 32.

Preferably, the primary positioning mechanism 50 further comprises a primary locking device (not shown). The primary locking device locks the primary transmission member 54 in a given position along the central axis of the first planing head 38. Such a locking device ensures that the first support 42 is fixed to the main frame 32 when positioned according to the desired parameters.

As the supports 42, 44 are positioned on opposite sides of the travelling course, displacing the second support 44 relative to the first support 42 changes the planing width 46. The planing width 46 is preferably defined as being normal to the travelling course of the piece of lumber. The planing width 46 arranged according to a predetermined planing treatment and/or desired final product.

As mentioned above, the primary positioning mechanism moves both planing heads simultaneously with respect to the main frame, There is further provided a secondary positioning mechanism operatively connecting the first and second supports, thereby moving the second planing head with respect to the first and changing the planing width in order to plane the sides of a piece of lumber according to desire specifications.

Referring to FIGS. 2 and 6, the secondary positioning mechanism 52 preferably includes at least one secondary transmission member 68 operatively connecting the first support 42 with the second support 44, and arranged to slide the second support 44. The secondary transmission member 68 can be similar or different from the primary transmission member 54. Preferably, two such secondary transmission members 68*a* and 68*b* are provided on either sides of the central axis of the planning assembly. Preferably, the secondary positioning mechanism 52 further includes a secondary drive 70 for driving each of the secondary transmission members 68*a*, 68*b*. This secondary drive 70 preferably includes a secondary servo-motor 76. The secondary servo-motor 76 is also preferably mounted to the first support.

Figure 3:
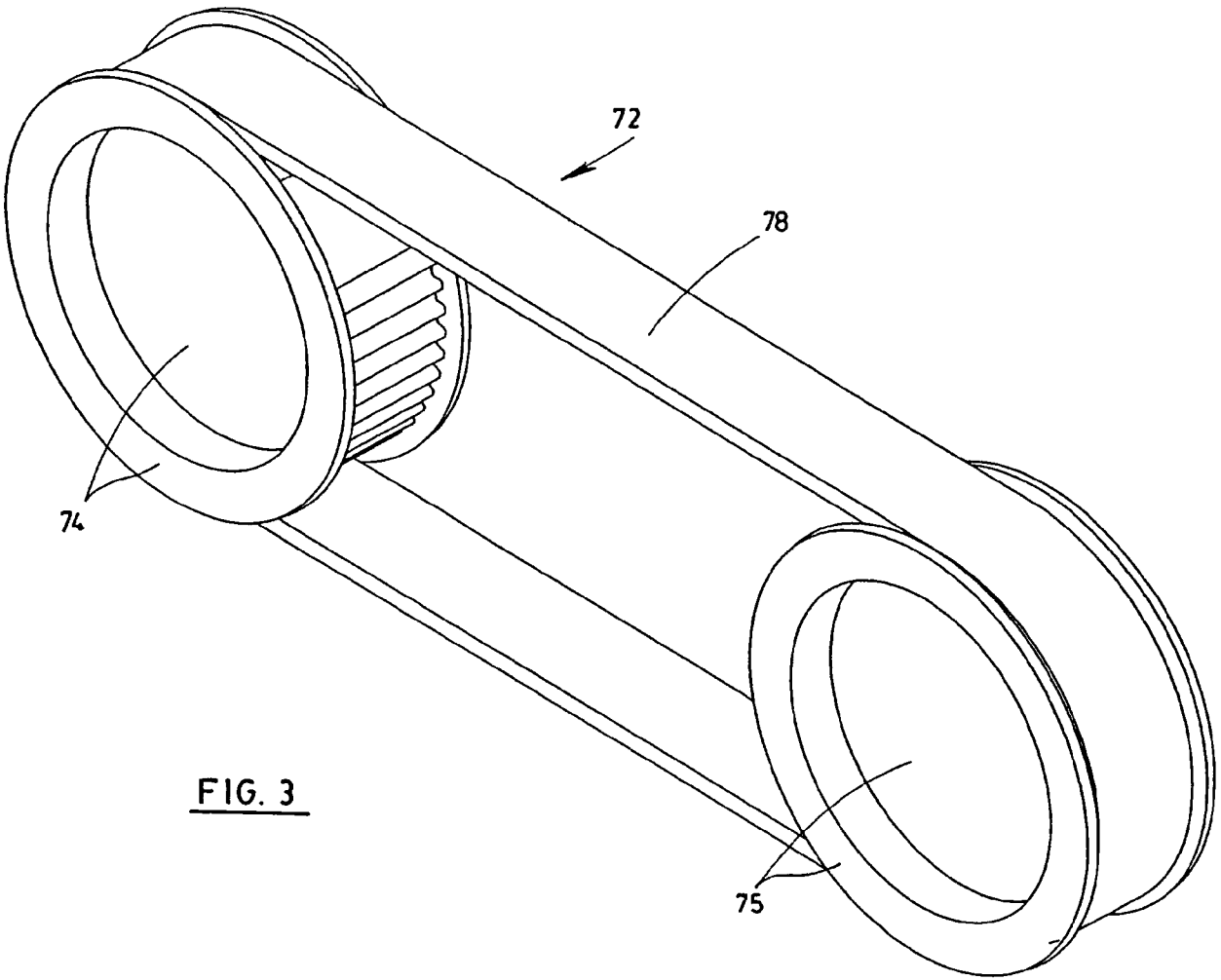
FIG. 3 is a perspective view of the region III of FIG. 2 and FIG. 14.

Still referring to FIG. 2 and further referring to FIG. 3, the secondary transmission members 68*a* and 68*b* are advantageously two screw-rods operatively connected to each other by a belt system 72, a close up of which is shown in FIG. 3. The belt system 72 connects the screw-rods 68*a* and 68*b*, ensuring that they are driven at a same rotational speed. The belt system 72 comprises a first drive wheel 74, rotatably connected to the secondary drive 70, and a second drive wheel 75 operatively connected to the first drive wheel 74 via a belt 78. The second drive wheel 75 is operatively connected to the second secondary transmission member 68*b*. Thus, the first and second drive wheels 74, 75 are rotated by the secondary drive 70 and in turn both screw-rods 68*a*, 68*b* are rotated simultaneously. Preferably, the two secondary transmission members 68*a*, 68*b* are respectively mounted to the planing assembly 33 on opposite sides of the second planing head 40. Alternatively, the secondary transmission members 68 may be mounted anywhere on the second support 44 in order to ensure that the second support 44 is slidable with respect to the first support 42.

Figure 4:
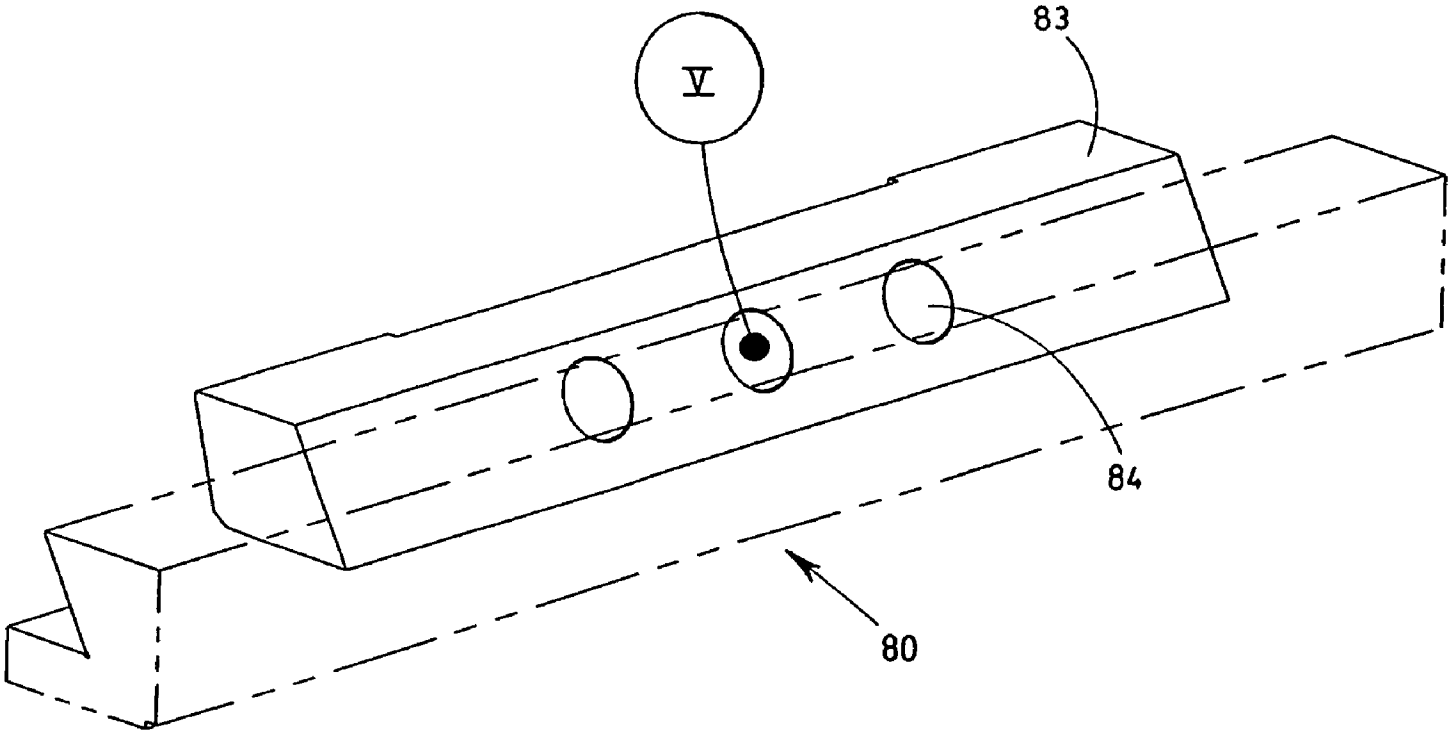
FIG. 4 is a perspective view of the region IV of FIG. 2.
Figure 5:
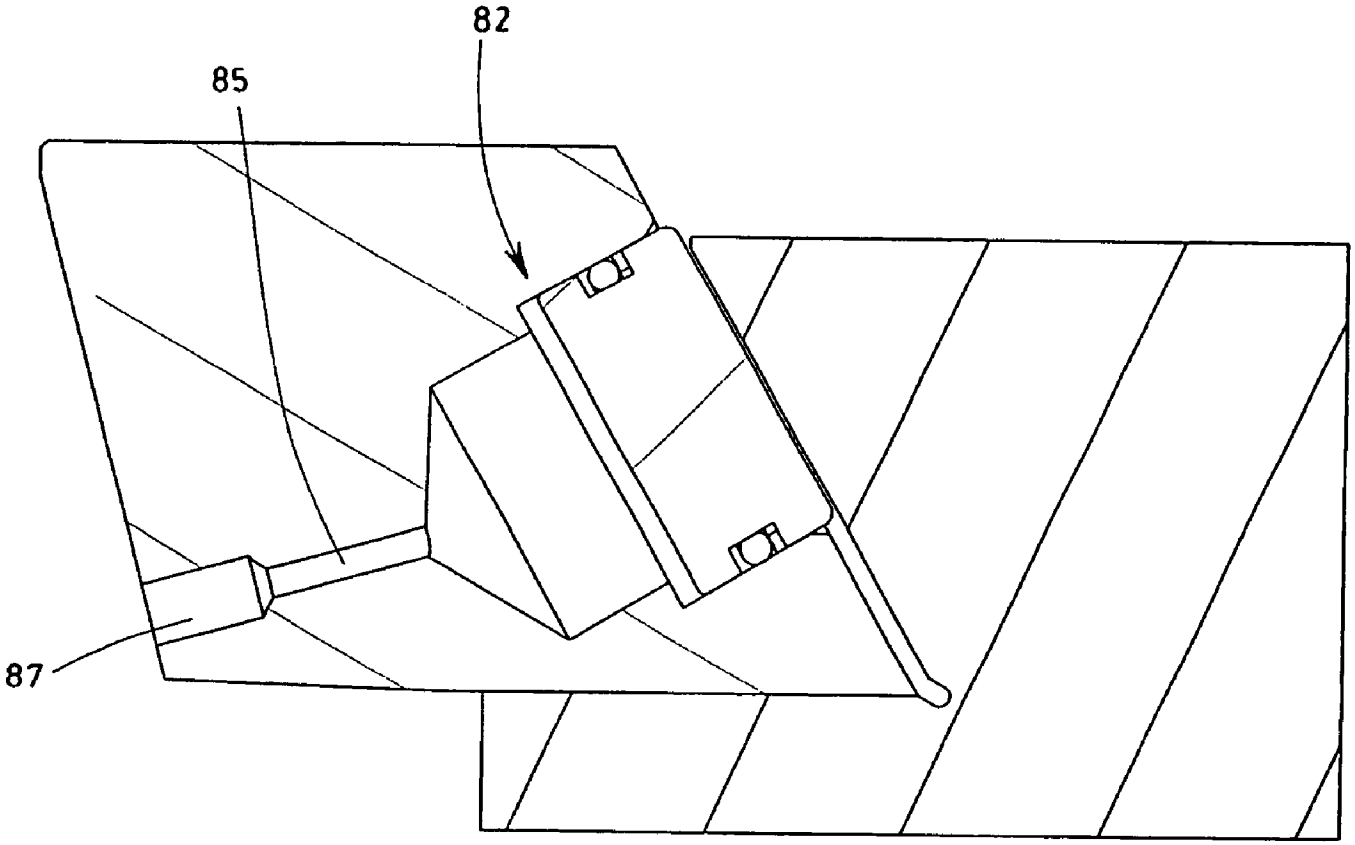
FIG. 5 is a perspective view of the region V of FIG. 4.

Still referring to FIG. 2 and further referring to FIGS. 4 and 5, the device advantageously includes a secondary locking device 80 for locking the second support 44 relative to the first 42, to lock the planing heads 38, 40 in a given planing width 46. The secondary locking device 80 is shown up close in FIGS. 4 and 5, and includes a piston 82 mounted to the second support 44 and a lock 83 mounted to the first support 42, the lock 83 being provided with a plurality of orifices 84. The piston 82 is advantageously activated by hydraulic pressure, and advantageously has a dovetail-shaped portion. A thin tube 85 and an oil channel 87, through which oil flows, are provided to activate the piston 82. The tube 85 and oil channel 87 allow oil under pressure to activate the piston 82, causing the latter to go into an orifice 84 to lock the second support 44 in place relative to the first support 42.

Figure 7:
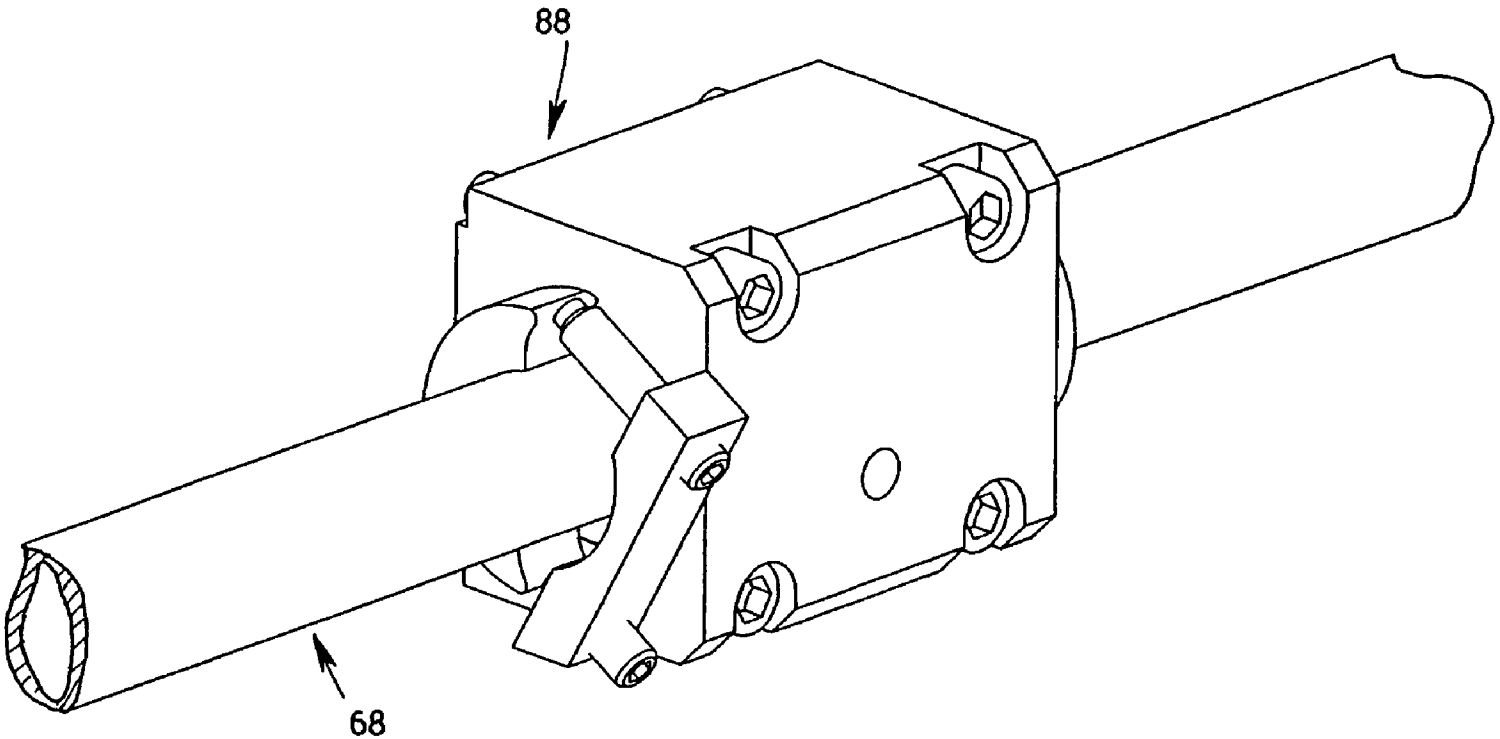
FIG. 7 is a perspective view of the region VII of FIG. 6.

Referring to FIGS. 6 and 7, the screws 68*a*, 68*b* are preferably operatively connected to a translator 88. The translator 88 is shown up close in FIG. 7. Advantageously, it may be a wingnut mounted to the secondary transmission member 68 and fixed to the second support 44. When the secondary transmission member 68 (as embodied by a screw) rotates, the translator 88 translates along the screw 68 and thereby translates the second support 44. The screw may be disposed of various threading patterns and the translator 88 is accordingly adapted thereto.

Referring now generally to FIGS. 12 to 19, there is shown a variant to the embodiment above where the primary and secondary positioning assemblies connect the various components of the device in a different manner.

Figure 12:
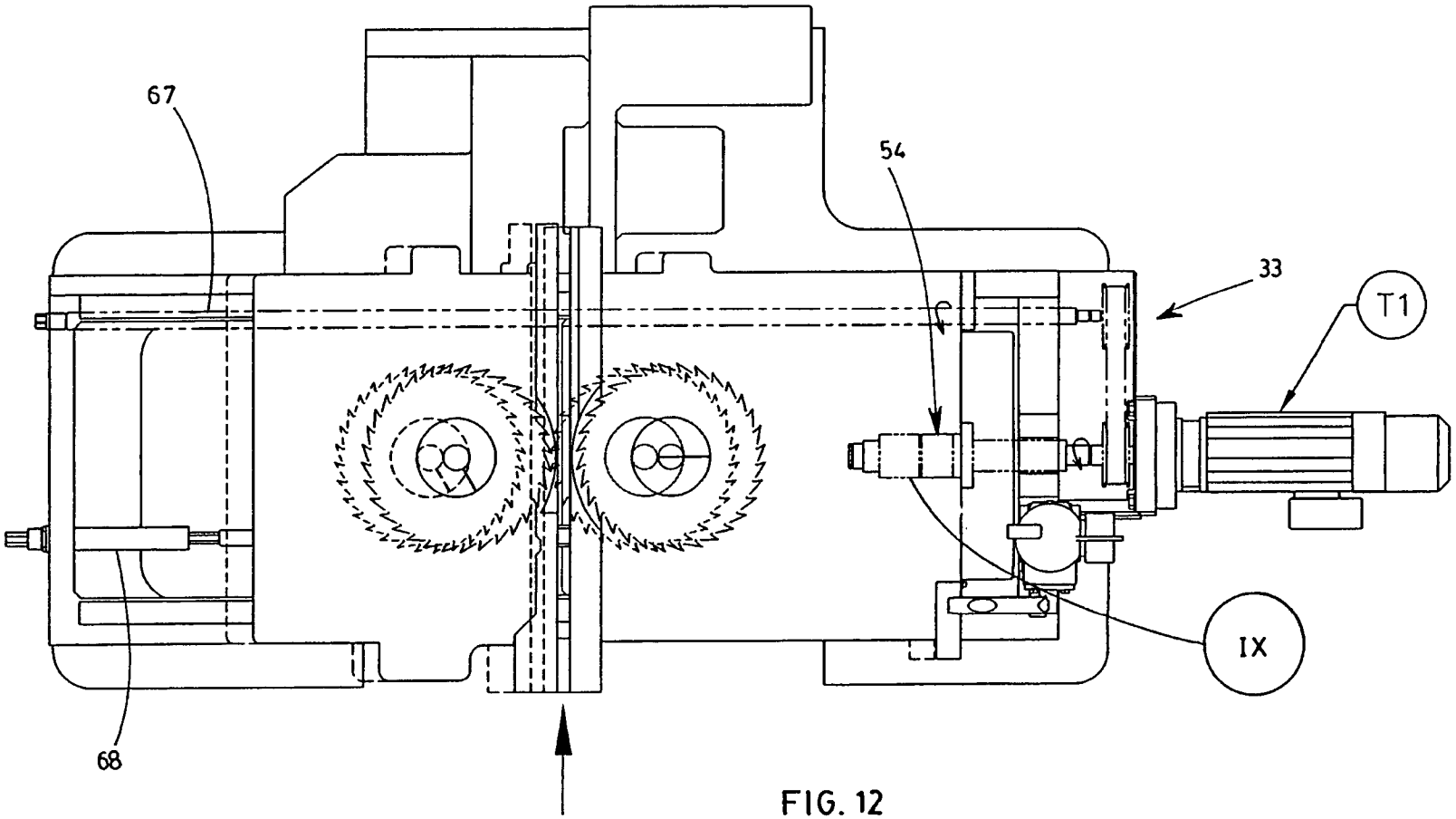
FIG. 12 is a top view of the device, according to a variant of the preferred embodiment of the invention, showing positioning of the first and second supports.
Figure 13:
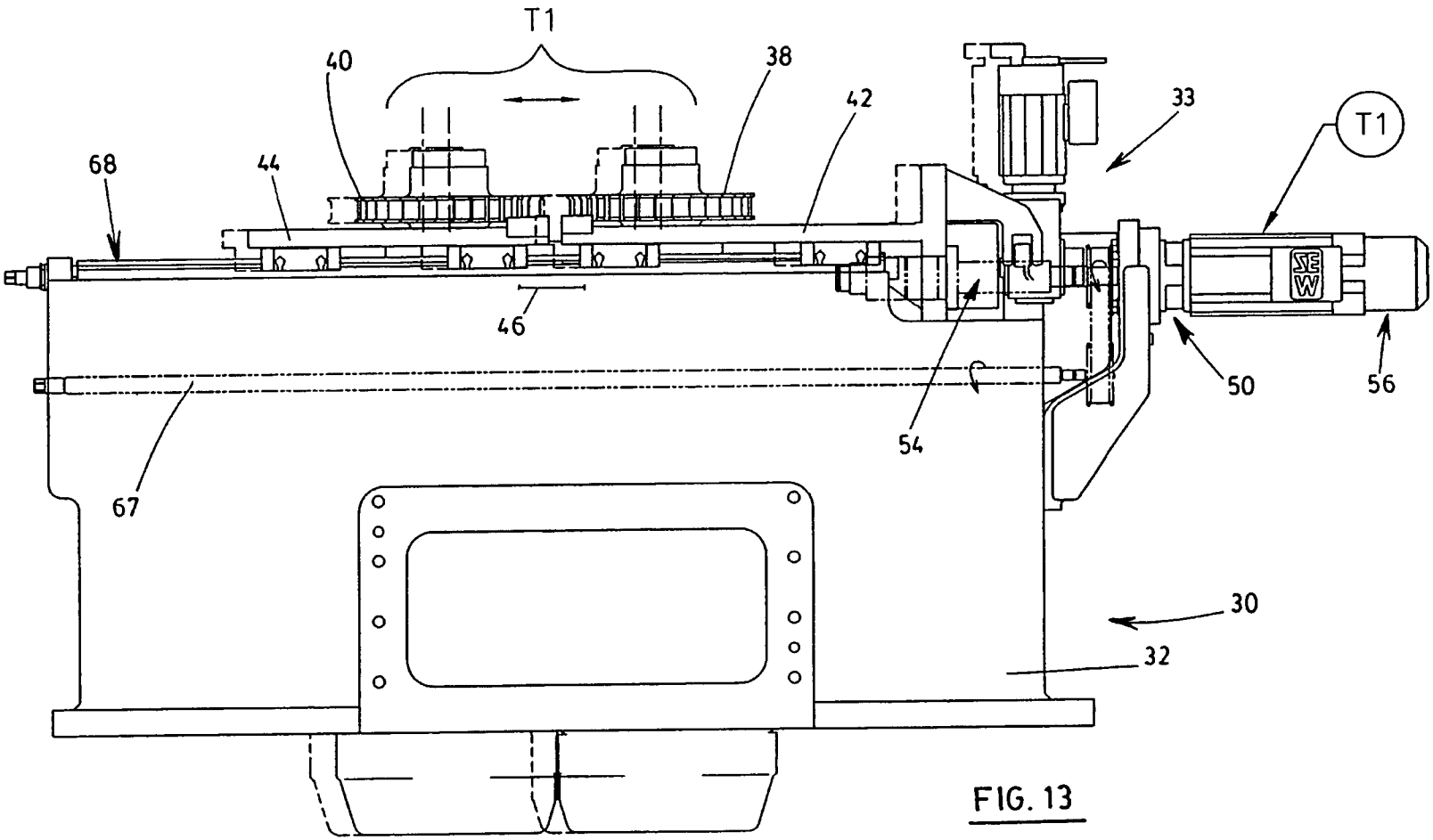
FIG. 13 is a side view of the device of FIG. 12.
Figure 14:
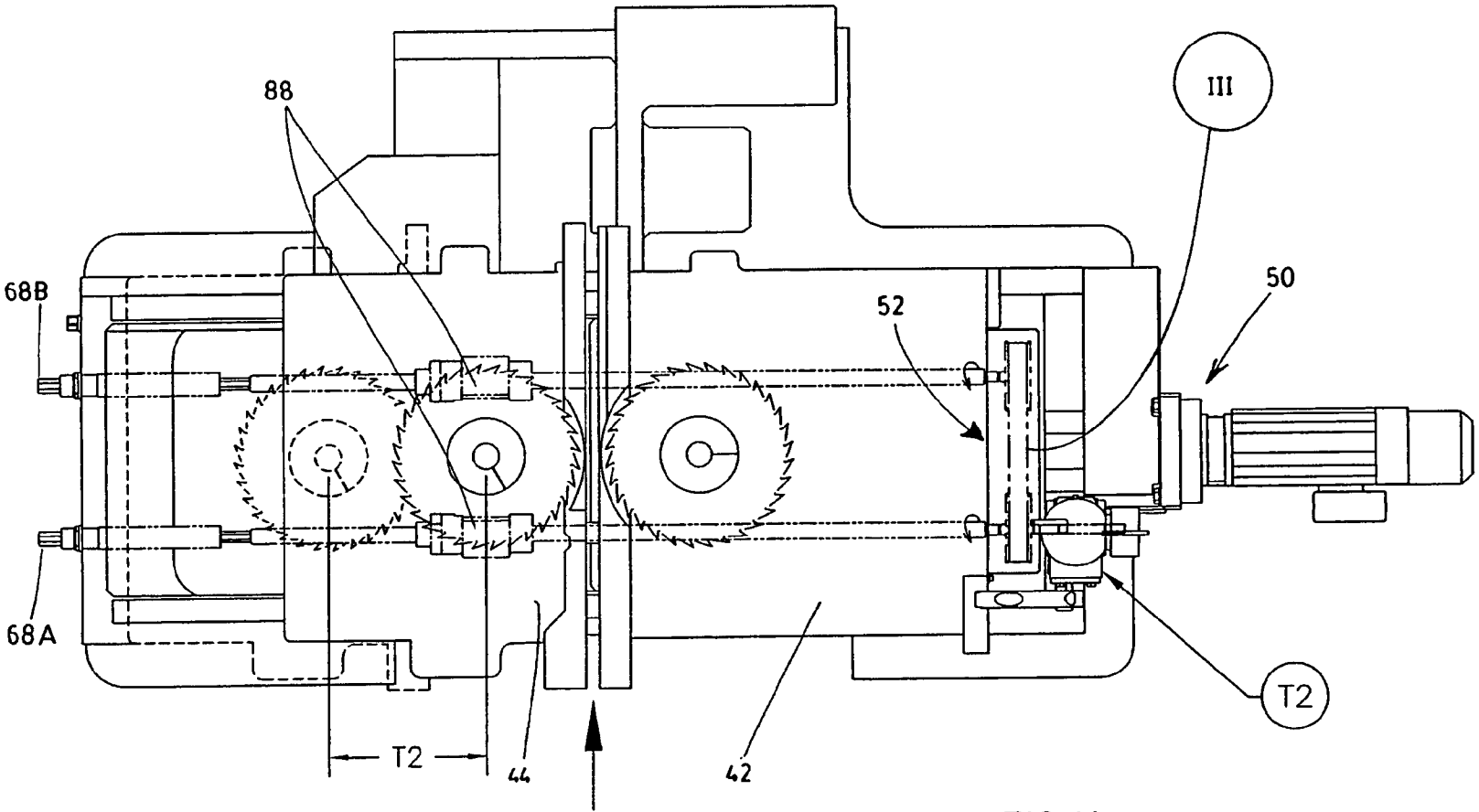
FIG. 14 is a top view of the device, according to the variant of the preferred embodiment, showing positioning of the second support with two secondary transmission members.
Figure 15:
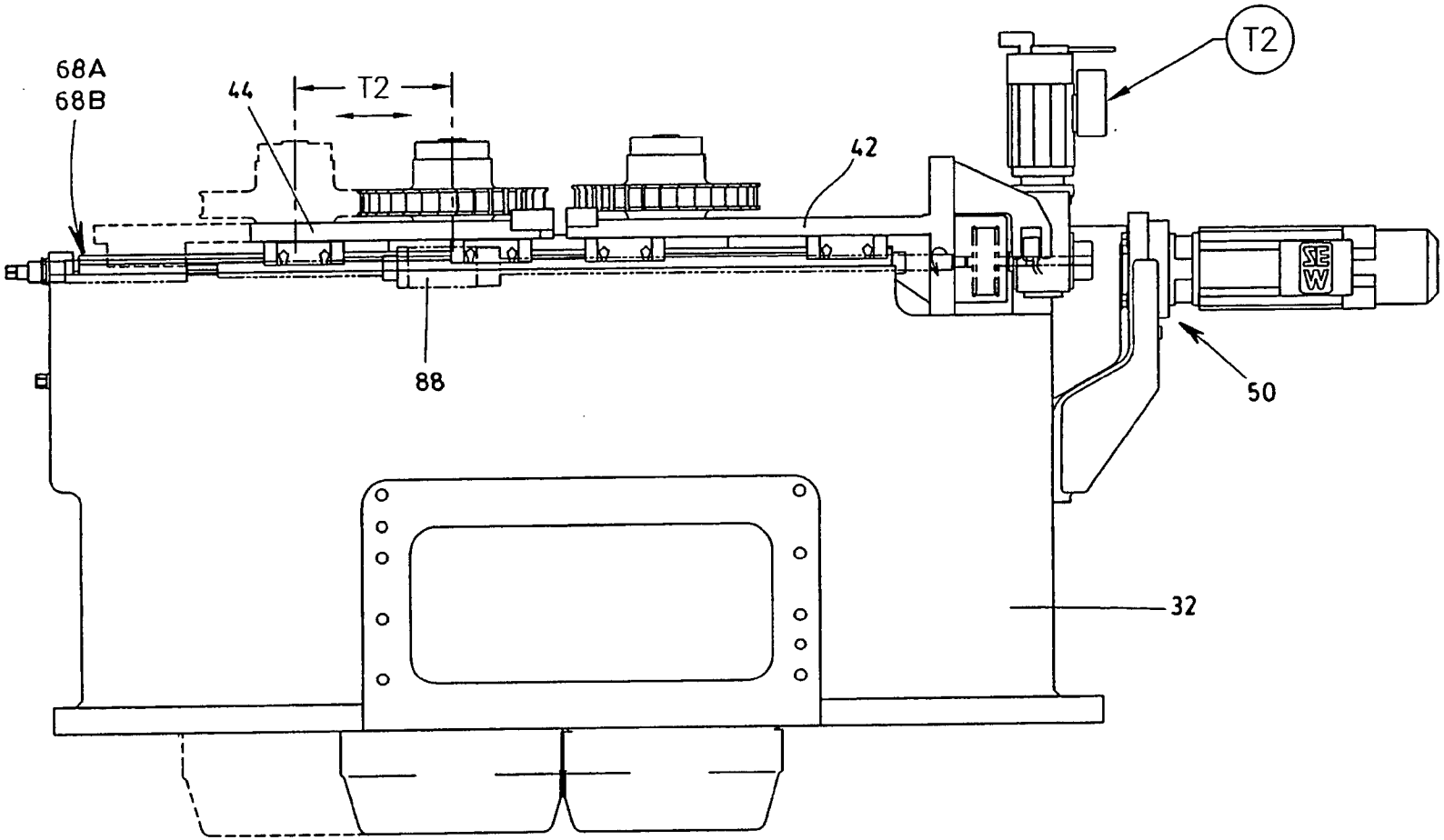
FIG. 15 is a side view of the device of FIG. 14.

Referring to FIGS. 12 and 13, the second support 44 is slidably mounted on the main frame 32 along with the first support 42. FIG. 13 shows the first and second supports 42, 44 translated on the main frame 32 a distance of T1. In this case, the supports 42, 44 are held together as one frame by the secondary transmission member 68. The weight of the planing assembly 33 is thus advantageously reduced. FIGS. 14 and 15 show the second support 44 translated relative to the first support 42 a distance of T2. The secondary positioning mechanism 52 preferably comprises two secondary transmission members 68A, 68B to translate the second support 42 on the main frame 32.

Figure 16:
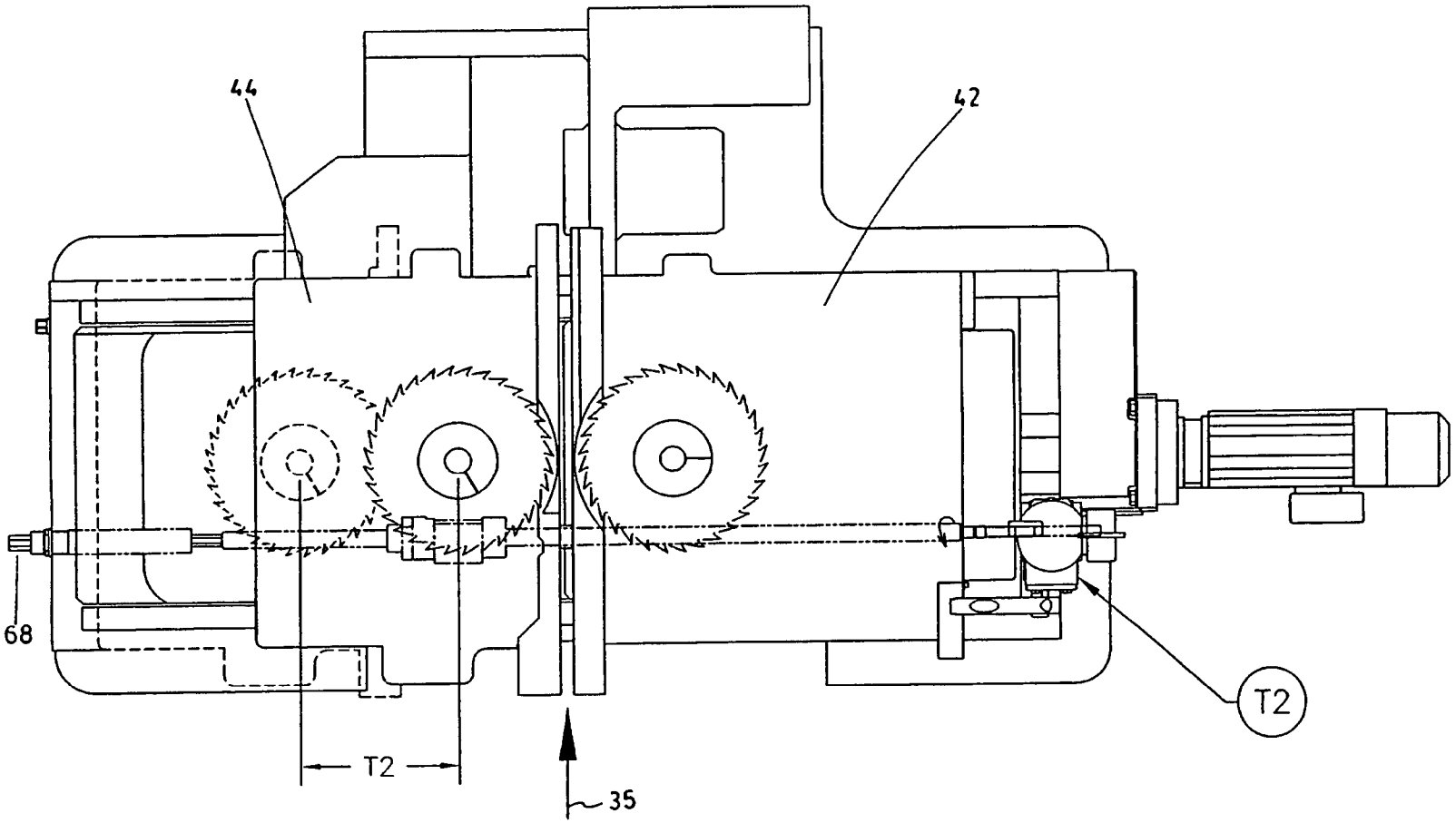
FIG. 16 is a top view of the device, according to the variant of the preferred embodiment, showing positioning of the second support with one secondary transmission members.
Figure 17:
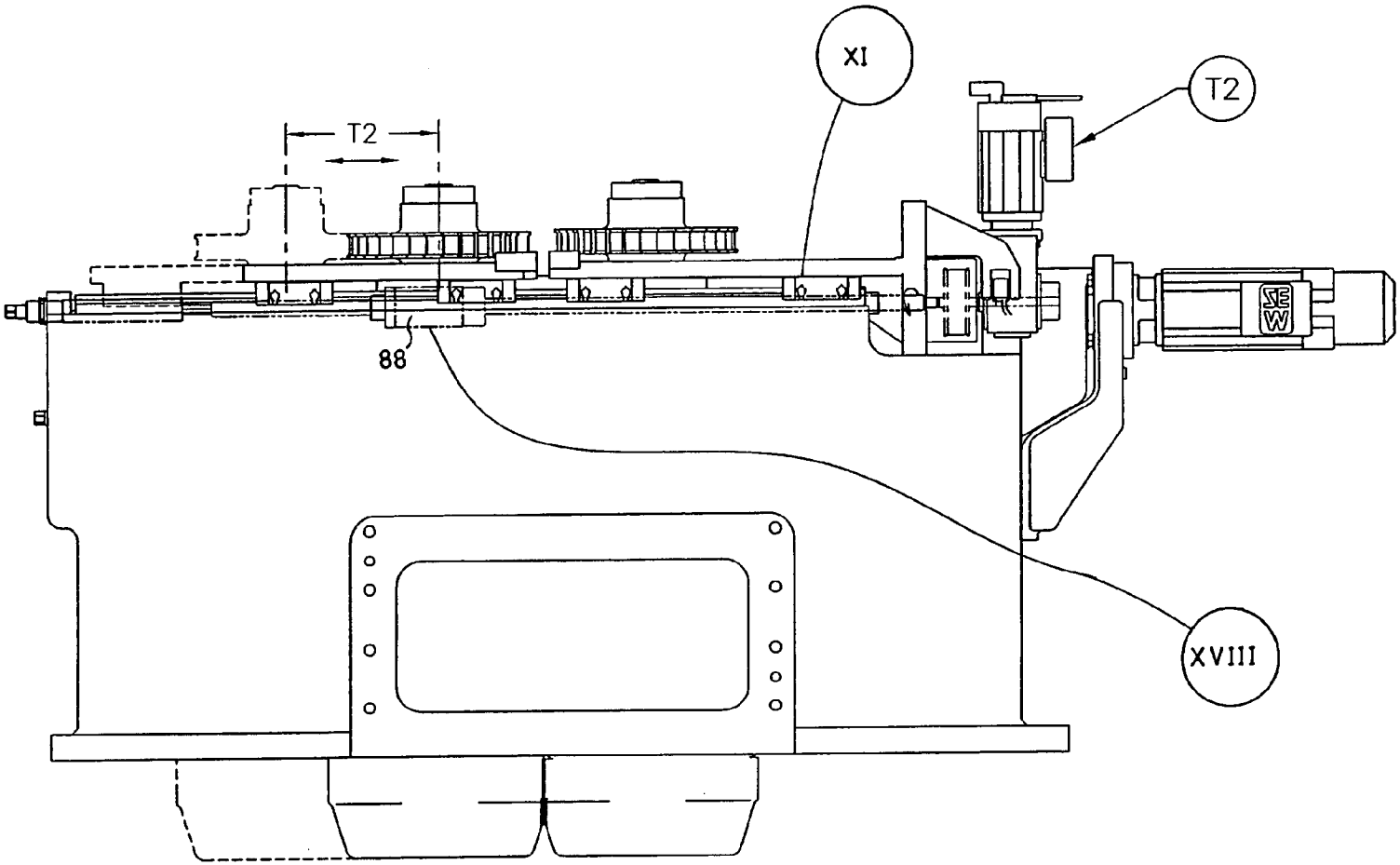
FIG. 17 is a side view of the device of FIG. 16.
Figure 18:
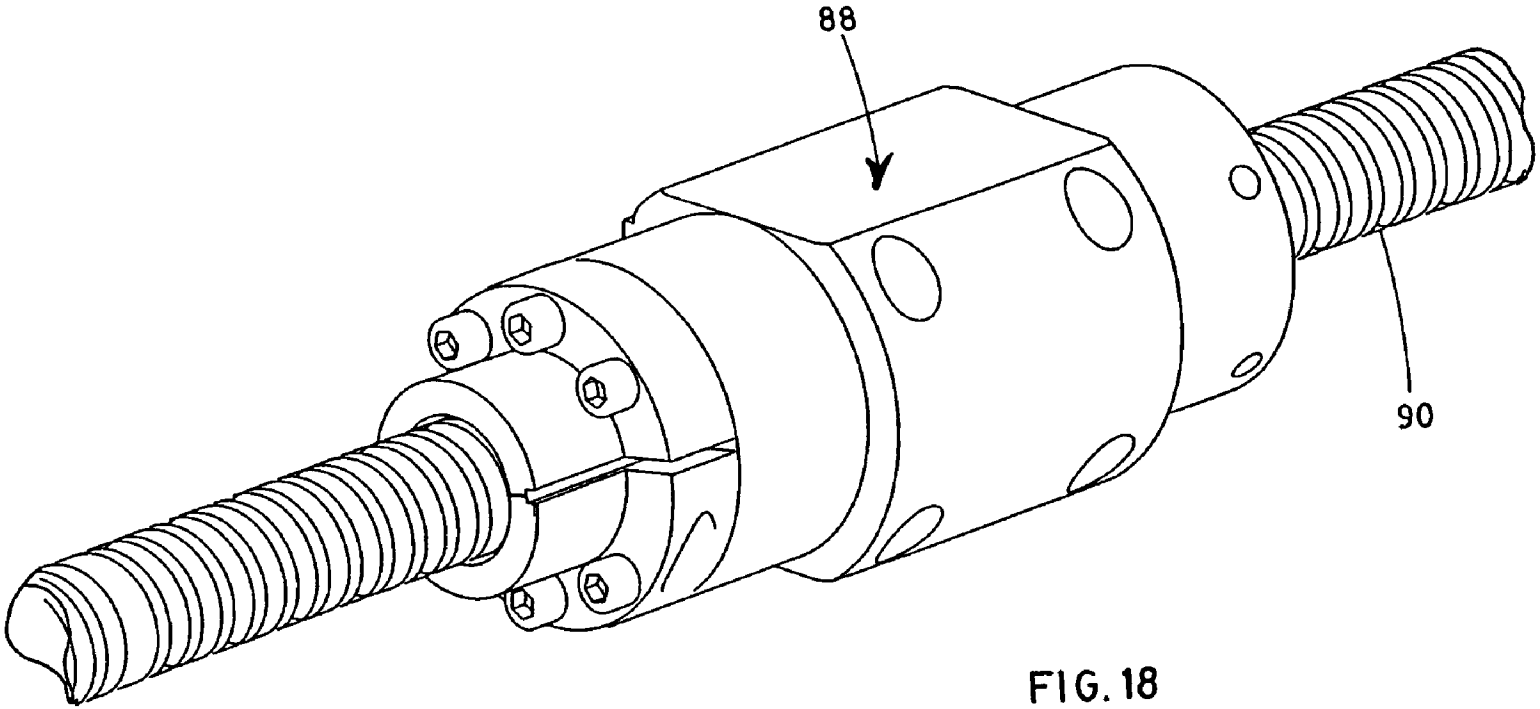
FIG. 18 is a perspective view of the region XVIII of FIG. 17.
Figure 19:
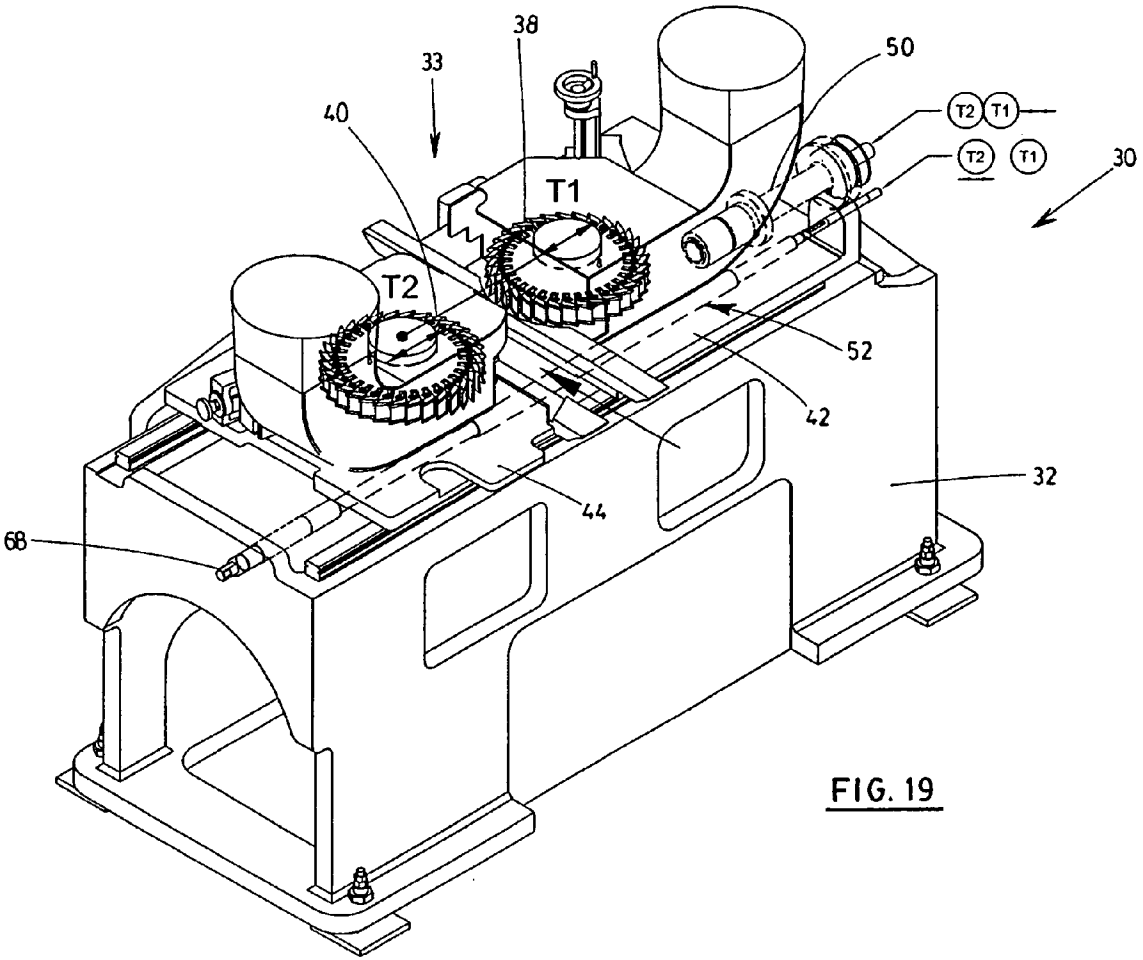
FIG. 19 is a perspective view of the device of FIG. 16.
Figure 20:
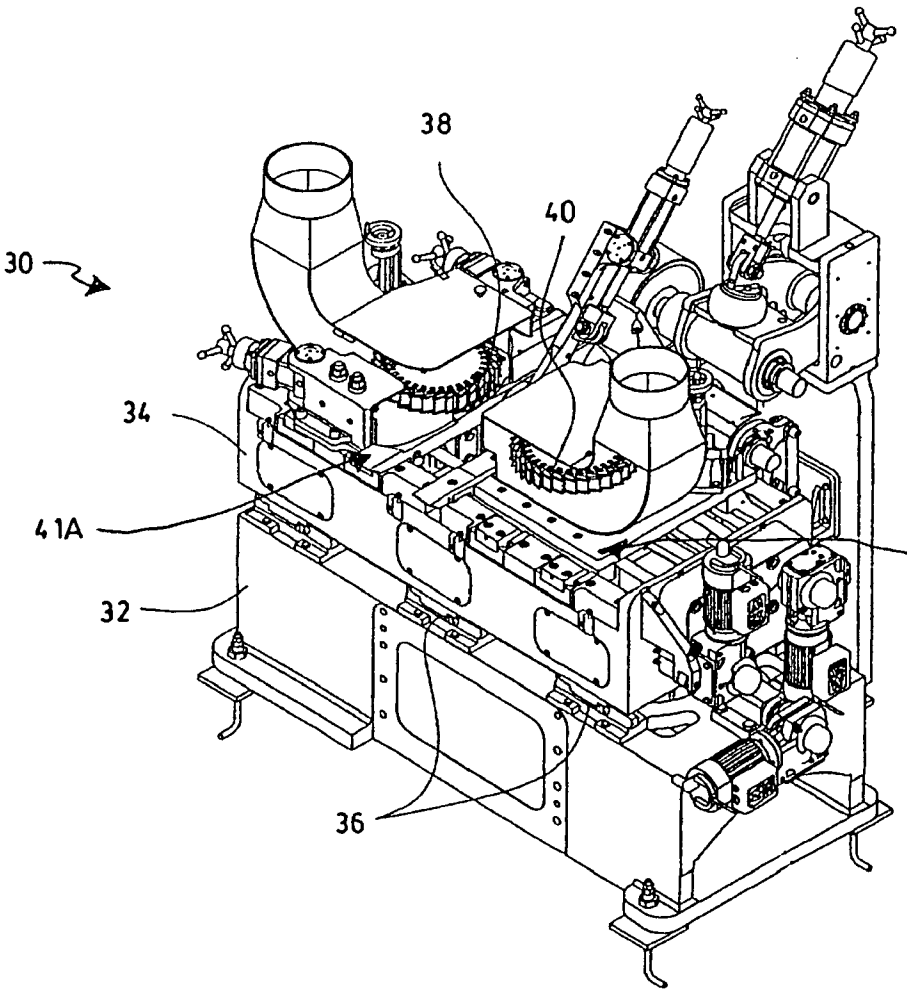
FIG. 20 (PRIOR ART)
FIG. 20 (PRIOR ART) is a perspective view of a planing positioning assembly, according to the prior art.
Figure 21:
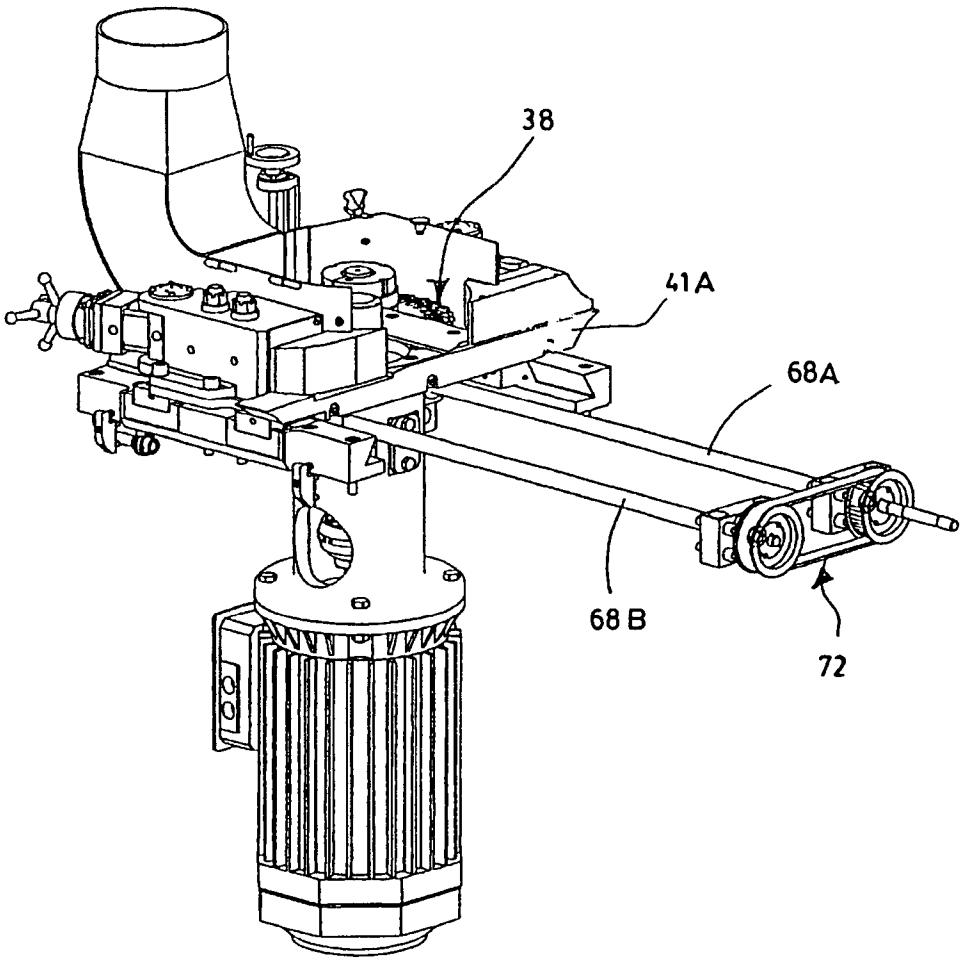
FIG. 21 (PRIOR ART)
FIG. 21 (PRIOR ART) is a perspective view of a planing head sub-frame and positioning means of the planing heads positioning means of FIG. 20.

Alternatively, as shown in FIGS. 16 and 17, the second support 44 is translated on the main frame 32 by only one secondary transmission member 68. Advantageously, the one secondary transmission member 68 is operatively connected on the front side of the second planing head 40, that is, the same side as the incoming piece of lumber. This arrangement improves the consistency and accuracy of the positioning while decreasing the weight of the device, among other things. As shown in FIG. 18, the member 68 is preferably a twill worm screw 90, and a translator 88 is mounted thereon. This translator 88 has a different construction than that shown in FIG. 7, but they function according to the same principles. Of course, a skilled workman may adapt various kinds of translators 88 (nuts, wingnuts, pistons, having various mountings, etc.) to convert rotational movement of the secondary transmission member 68 into translational movement of the second support 44.

The secondary transmission member 68 is preferably locked in place by the secondary servo-motor 76 itself. The secondary servo-motor 76 thus restrains the secondary transmission member 68 in place once it has moved the second support 44 to adjust the planing width 46.

In numerous figures, such as FIG. 1, the references characters T1 and T2 indicate the displacement of the entire planing assembly 33 and the second support 44 respectively. Also, as in FIG. 2, a dotted outline is used to indicate that the second support 44 is displaceable from one position to another. In FIG. 8, for example, the dotted outline indicates that first 42 and second supports 44 are displaceable together. Furthermore, arrows indicate displacements of first 42 and second 44 supports relative to the main frame 32 or to each other. Curved arrows show the rotational direction of the primary and secondary transmission members 54, 68, or of other ancillary transmission members. For example, FIGS. 2 and 6 show with a rotational arrow that the secondary transmission members 68*a*, 68*b* are rotated, thus causing the second support 44 (along with the second planing head 40) to be translated a distance of T2. Furthermore, FIGS. 8 and 10 show with an arrow that the primary transmission member 54 is rotating, and thus causing both the first 42 and second 44 supports (along with the first 38 and second 40 planing heads) to be simultaneously displaced a distance of T1. Other figures show displacements using similar reference characters, arrows and dotted outlines, and are appreciable by a skilled workman.

The planing heads positioning device may also be used in conjunction with position encoders (not shown), respectfully coupled to the planing heads, for producing position signals indicative of the positions of the planing heads. Controllers (not shown) may also be used for controlling the drives that position the supports.

Although preferred embodiments of the present invention have been described in detail herein and illustrated in the accompanying drawings, it is to be understood that the invention is not limited to these precise embodiments and that various changes and modifications may be effected therein without departing from the scope or spirit of the present invention.

What is claimed is:

1. A planing heads positioning device to be used with an automatic planing machine having a main frame, for planing sides of a piece of lumber moving along a travelling course, said device comprising:

a planing assembly comprising a first planing head and a second planing head respectively arranged on opposite sides of the travelling course of the piece of lumber and defining a planing width therebetween, said planing assembly further comprising a first support and a second support respectively supporting the first and second planing heads, the first support being slidably mounted to the main frame, and the second support being operatively connected to the first support;

a primary positioning mechanism operatively connected to the first support to position the planing assembly relative to the main frame;

a secondary positioning mechanism operatively connected to said first and second supports to position said second support relative to the first support, thereby changing the planing width, to plane the sides of the piece of lumber.

2. The planing heads positioning device as claimed in claim 1, wherein the primary positioning mechanism comprises a primary transmission member engaging the first support and arranged to slide the planing assembly substantially perpendicularly relative to the travelling course of the piece of lumber, and a primary drive for driving the primary transmission member.

3. The planing heads positioning device as claimed in claim 2, wherein the primary transmission member comprises a screw and a piston, the screw being rotatably connected to the primary drive and operatively connected to the piston to push the same, said piston being operatively connected to the planing assembly to simultaneously displace the first and second supports.

4. The planing heads positioning device as claimed in claim 2, wherein the primary drive comprises at least one servo-motor.

5. The planing heads positioning device as claimed in claim 2, wherein the primary transmission member engages the first support substantially along a central axis of the first planing head.

6. The planing heads positioning device as claimed in claim 2, wherein the primary positioning mechanism further comprises a stabilizing transmission member operatively connected to the primary transmission member and rotatably connected to the main frame, the stabilizing transmission member being driven by the primary transmission member to rotate simultaneously therewith in order to stabilize the same.

7. The planing heads positioning device as claimed in claim 1, further comprising linear slides slidably connecting the first support to the main frame, said linear slides comprising a rail mounted on the main frame and a slide car slidably mounted to the rail and fixed to the first support.

8. The planing heads positioning device as claimed in claim 1, wherein the secondary positioning mechanism comprises:

at least one secondary transmission member operatively connecting the first and second supports and arranged to slide the second support; and a secondary drive for driving said at least one secondary transmission member.

9. The planing heads positioning device as claimed in claim 8, wherein the secondary drive comprises at least one servo-motor.

10. The planing heads positioning device as claimed in claim 8, wherein said at least one secondary transmission member comprises two secondary transmission members each operatively connecting the first and second supports, said two secondary transmission members being respectively operatively mounted to the planing assembly on opposite sides of the second planing head.

11. The planing heads positioning device as claimed in claim 10, wherein the secondary drive further comprises two interconnected drive wheels respectively operatively connected to the two secondary transmission members.

12. The planing heads positioning device as claimed in claim 10, wherein each of said two secondary transmission members comprises a rod and a translator, the translator being operatively connected to the rod and fixed to the second support, the rod being rotated by the secondary drive to translate the translator along the rod, to thereby displace the second support.

13. The planing heads positioning device as claimed in claim 8, wherein the second support is slidably mounted on the first support.

14. The planing heads positioning device as claimed in claim 13, further comprising a locking mechanism operatively connecting the first and second supports to lock the second support in a given position on the first support.

15. The planing heads positioning device as claimed in claim 14, wherein the locking mechanism comprises a lock with a plurality of orifices provided therein, the lock being mounted to the first support, the locking mechanism further comprising a piston mounted to the second support and being movable into one of said plurality of orifices to thereby lock the second support on the first support.

16. The planing heads positioning assembly as claimed in claim 8, wherein the second support is slidably mounted on the main frame.

17. The planing heads positioning device as claimed in claim 16, wherein said at least one secondary transmission member comprises one secondary transmission member operatively connecting the first and second supports on a front side of the first and second planing heads relative to the travelling path of the piece of lumber.

18. The planing heads positioning device as claimed in claim 17, wherein the one secondary transmission member comprises a twill worm screw operatively connecting the first and second supports and rotatable by the secondary drive means, and a translator mounted to the second support and operatively connected to the twill worm screw, the translator being translated when the twill worm screw is rotated, thereby displacing the second support.

* * * * *